US007234242B2

(12) United States Patent
Yao

(10) Patent No.: US 7,234,242 B2
(45) Date of Patent: Jun. 26, 2007

(54) ADJUSTABLE APPARATUS FOR HAIR CLIPPER

(76) Inventor: Woody Yao, 10F-8, No. 18, Lane 609, Sec. 5, Chung Hsin Rd., San Chung City, Taipei (TW)

( * ) Notice: Subject to any disclaimer, the term of this patent is extended or adjusted under 35 U.S.C. 154(b) by 33 days.

(21) Appl. No.: 11/271,794

(22) Filed: Nov. 14, 2005

(65) Prior Publication Data

US 2007/0107234 A1 May 17, 2007

(51) Int. Cl.
*B26B 19/20* (2006.01)

(52) U.S. Cl. ..... 30/201; 30/233

(58) Field of Classification Search ..... 30/200–202, 30/223–224, 43.1–43.2, 196, 233, 233.5, 30/208, 43.91, 43.92
See application file for complete search history.

(56) References Cited

U.S. PATENT DOCUMENTS

| | | | | |
|---|---|---|---|---|
| 5,325,589 | A * | 7/1994 | Kubo | 30/201 |
| 5,367,772 | A * | 11/1994 | Ogawa | 30/201 |
| 6,260,276 | B1 * | 7/2001 | Lebherz et al. | 30/201 |
| 6,308,415 | B1 * | 10/2001 | Sablatschan et al. | 30/43.92 |
| 6,578,269 | B2 * | 6/2003 | Wilcox et al. | 30/201 |
| 6,742,262 | B2 * | 6/2004 | Rizzuto et al. | 30/201 |
| 7,100,286 | B2 * | 9/2006 | Nakakura et al. | 30/201 |

* cited by examiner

*Primary Examiner*—Kenneth E. Peterson
*Assistant Examiner*—Phong Nguyen
(74) *Attorney, Agent, or Firm*—Troxell Law Office, PLLC

(57) ABSTRACT

The invention discloses an adjustable apparatus for adjusting an upper blade position of a hair clipper to further adjust the hair cut length. The upper blade is connected to a blade spring. The blade spring is placed in a spring housing. The spring housing is connected to a pushing block. The pushing block is connected to a rotary wheel. Therefore, the position of the upper blade is adjustable by moving the rotary wheel.

7 Claims, 5 Drawing Sheets

ADJUSTABLE APPARATUS FOR HAIR CLIPPER

BACKGROUND OF THE INVENTION (a) Field of the Invention

The invention relates to an adjustable apparatus for a hair clipper, and more particularly, to an adjustable apparatus for a hair clipper, in that the adjustable apparatus moves an upper blade assembly using a pushing block driven by a rotary wheel and restores the upper blade assembly to an original position thereof using a spring blade, thereby moving the upper blade as desired.

(b) Description of the Prior Art

Electric hair cutters are often used in household-styled barber shops and beauty parlors. To meet customers' needs on hair lengths, a length adjuster is necessarily installed to a tip section of a blade of the electric hair cutter in order to control lengths of hair being cut. However, due to various needs of different customers, a diversity of length adjusters is required, and tremendous usage inconveniences are resulted. Also, economical values are disadvantaged for that length adjusters of numerous styles must be additionally purchased.

To overcome the aforesaid drawback, an electric hair cutter using principles of an inclined surface for accomplishing position adjustment of a cutter thereof had become available. Such prior electric hair cutter is provided with a loop-like adjustment switch, a sliding channel with a spiral inclined surface devised in a dented manner at an inner wall of the adjustment switch, a protruding block at a front end thereof, and a blade driving rod connected to a lower side of the protruding block, with the protruding block fastened in the sliding channel of the adjustment switch. When a user rotates the adjustment switch, the protruding block at the blade driving rod is allowed with back and forth sliding movements along the spiral inclined sliding channel at the adjustment switch to adjust positions of the blade, thereby controlling lengths of hair being cut. However, this prior invention is again disadvantaged that it cannot be operated with one hand but can only be smoothly operated using both hands, and thus is yet considered as unhandy when operated.

In the view of the several drawbacks of the prior invention, it is a vital task of the invention as how to provide a novel adjustable apparatus for a hair clipper that overcomes the aforesaid drawbacks.

SUMMARY OF THE INVENTION

The primary object of the invention is to provide an adjustable apparatus for a hair clipper, in that the adjustable apparatus allows a user to operate a rotary wheel to the left or right with small forces applied by one hand, such that distances of an upper blade being moved forward or backward are controlled for accomplishing objects of operating the electric hair cutter with ease and convenience.

The other object of the invention is to provide an adjustable apparatus for a hair clipper, in that the adjustable apparatus promotes advancement of the electric hair cutter industry apart from having simple assembly process and operation as well as low production costs.

To accomplish the aforesaid objects, an adjustable apparatus for a hair clipper comprises a cutter assembly joined to a front end of an electric hair cutter housing, a pushing block and a rotary wheel. The cutter assembly is consisted of a stationary blade seat and an upper blade assembly, wherein the upper blade assembly is provided at an upper surface of the stationary blade seat. The upper blade assembly has a upper blade seat, and a locating spring secured at an interior of a spring housing. Two ends of the locating spring are joined with an upper surface of the upper blade seat for interlocking effects between the upper blade seat and the spring housing. A spring blade is provided between the upper blade seat and the spring housing, and is butted against the spring housing, such that the spring blade is generated with a restoring force from compression when the spring housing is moved forward. A fastening block is extended from a rear end of the pushing block, which is for pivotally connecting the pushing block to a rear end of the stationary blade seat and is butted against the spring housing for allowing the pushing block to propel the spring housing forward. The rotary wheel is devised with an adjustment region having a step-like adjustment portion, and is joined to a front end of the electric cutter housing, in a way that an edge of the rotary wheel is protruding out of the electric cutter housing for adjustment by turning. The fastening block of the pushing block is accommodated in the adjustment region of the rotary wheel, and is lodged at one of the steps of the adjustment region, such that turning of the rotary wheel is limited within the adjustment region. When a user turns the rotary wheel toward higher-level steps of the step-like adjustment portion, the fastening block of the pushing block is affected by turning of the rotary wheel to simultaneously propel the spring housing and the upper blade seat forward to further locate the spring housing and the upper blade seat. At this point, the spring blade is compressed to produce a restoring force from the forward movement of the spring housing. When the rotary wheel is turned toward lower-steps of the adjustment portion, the pushing block is moved backward with a certain distance to liberate the spring housing that is then also moved backward using the restoring force of the spring, thereby accomplishing adjustment of the upper blade.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
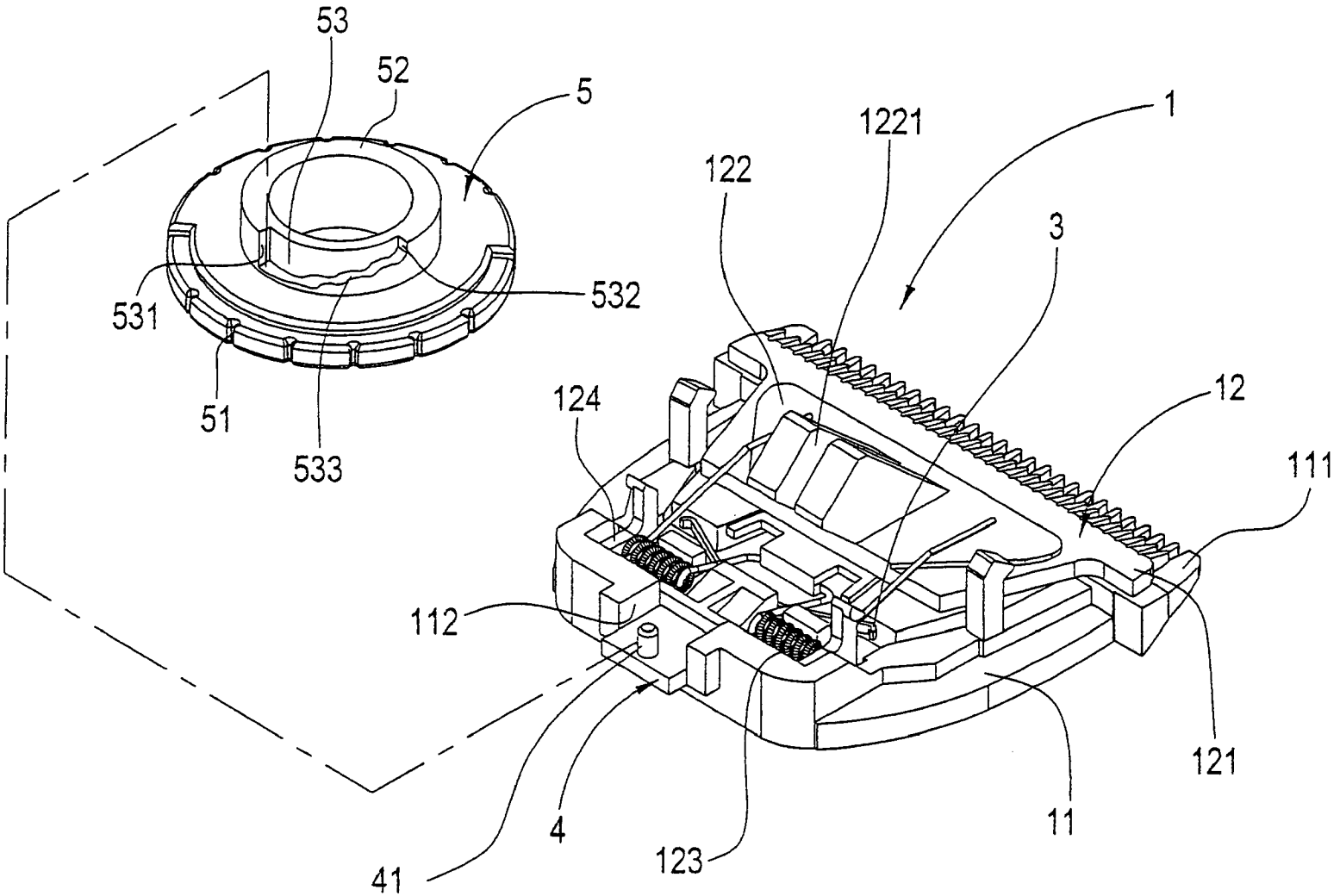
FIG. 1 shows a partial schematic view illustrating an assembly of the adjustable apparatus for a hair clipper according to the invention.
Figure 2:
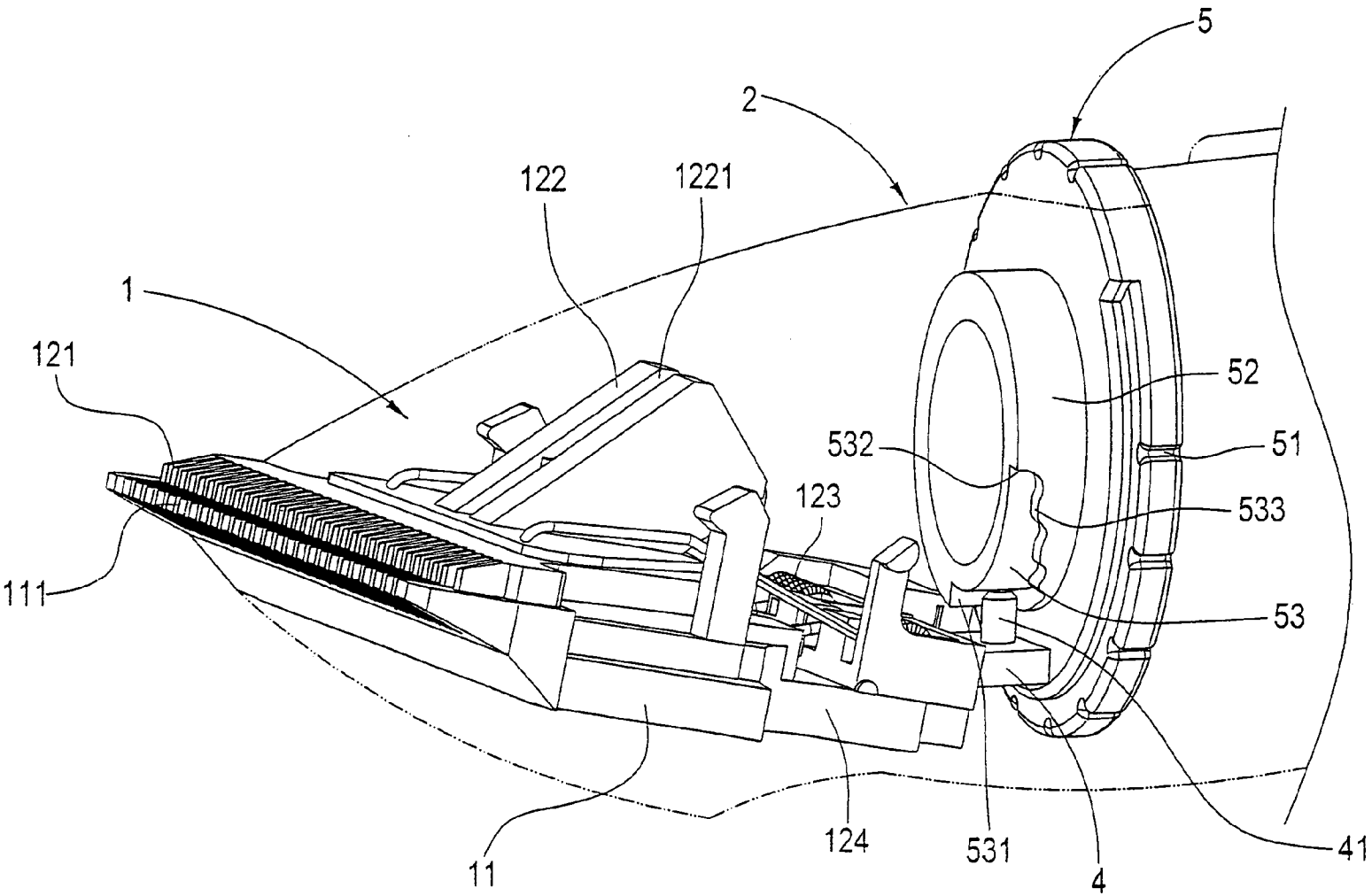
FIG. 2 shows a partial elevational view of the adjustable apparatus for a hair clipper according to the invention.
Figure 3:
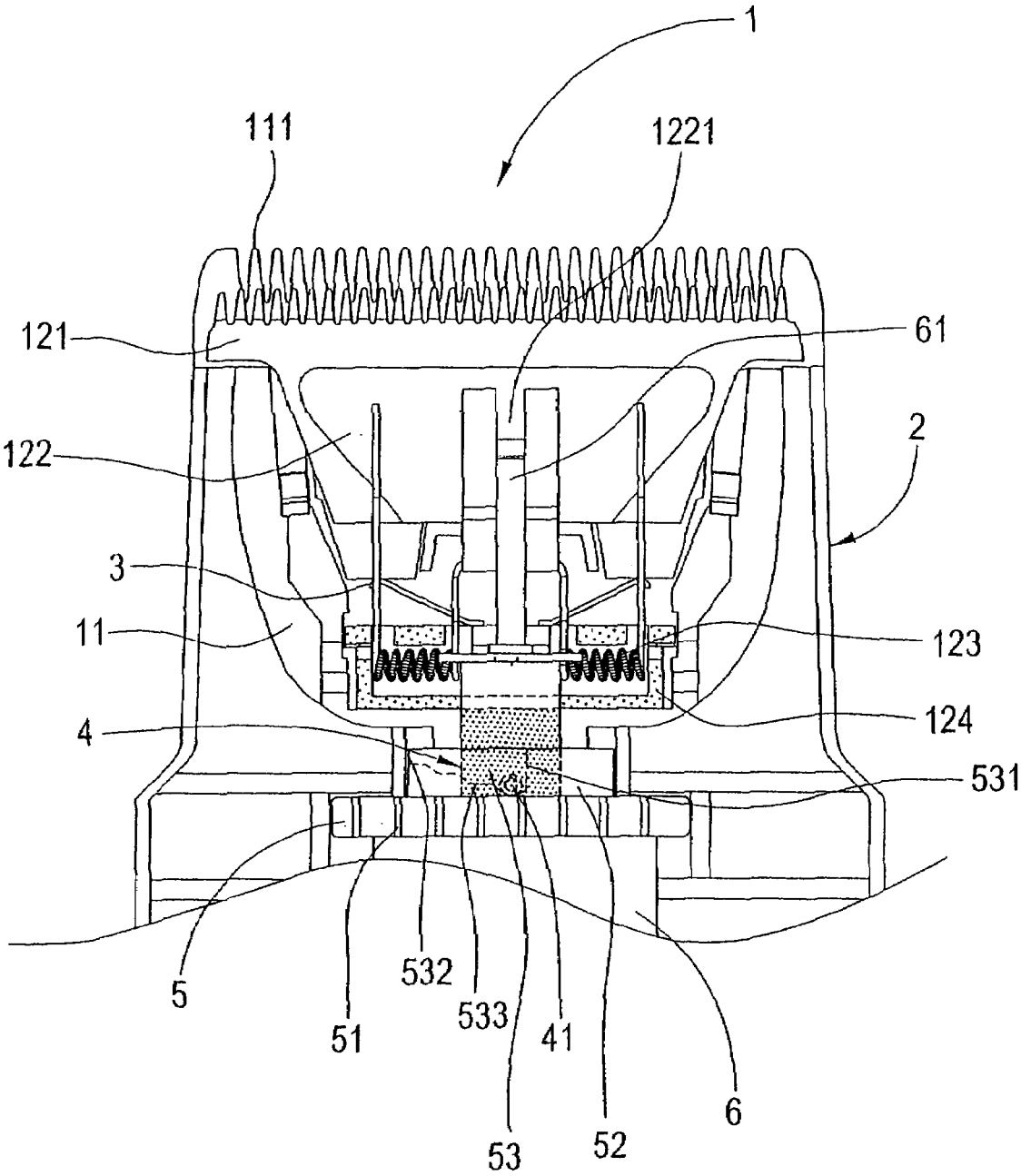
FIG. 3 and FIG. 4 show schematic views illustrating movements of the adjustable apparatus for a hair clipper according to the invention.
Figure 4:
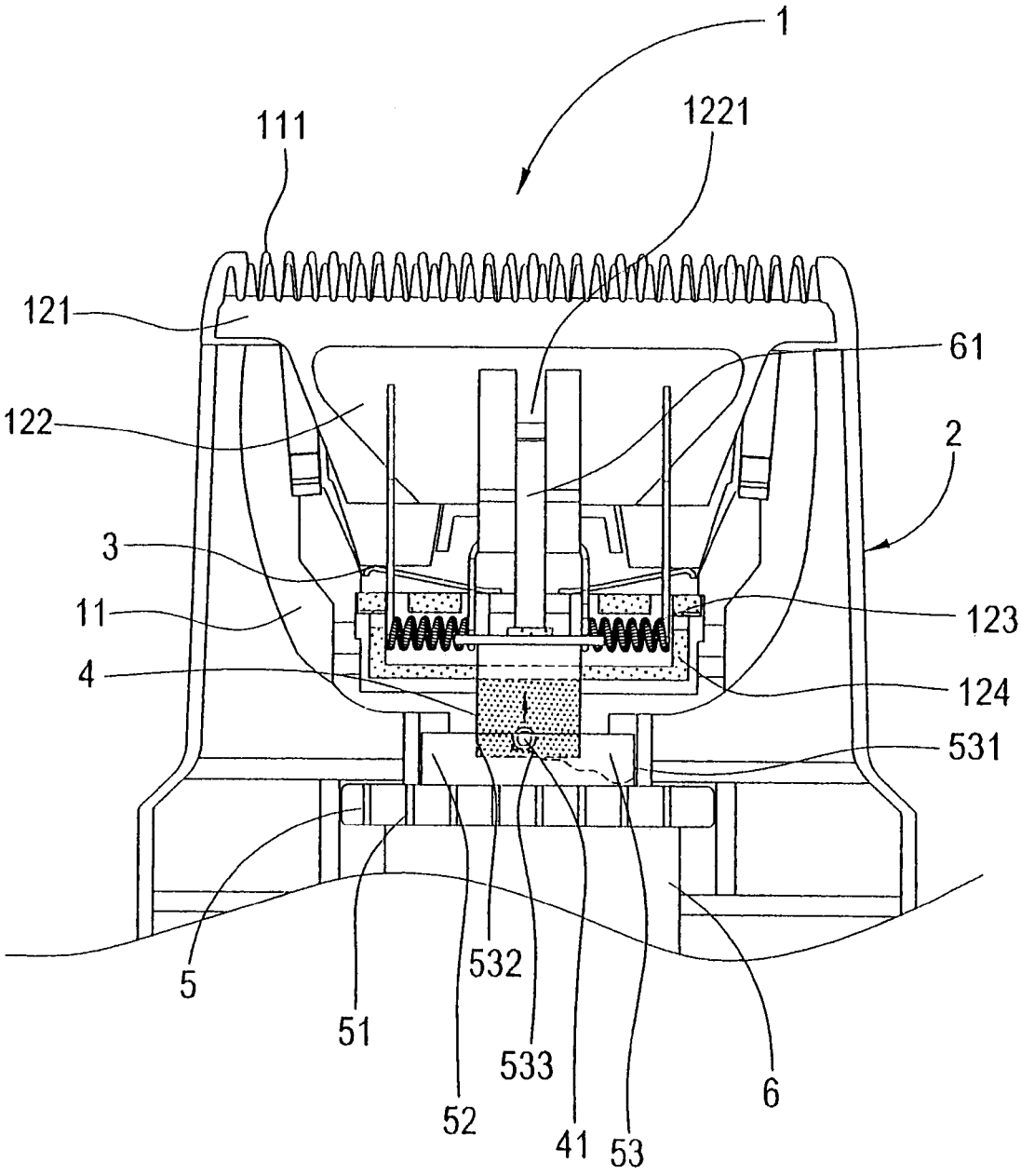

Referring to FIG. 1 and FIG. 2, an adjustable apparatus for a hair clipper according to the invention comprises:

a cutter assembly 1 joined to a front end of an electric hair cutter housing 2, and consisted of:

a stationary blade seat 11, which has a connected stationary blade 111 having a cutting edge thereof projecting from a front end of the electric hair cutter housing 2, and a sliding channel 112 extended from a rear end thereof; and an upper blade assembly 12 having an upper blade 121, an upper blade seat 122, and a locating spring 123 secured at an interior of a spring housing 124; wherein, the upper blade seat 122 is provided with a fastening groove 1221 for joining two ends of the locating spring 123 with an upper surface of the upper blade seat 122, such that the upper blade seat 122, the locating spring 123 and the spring housing 124 are joined to form one body having interlocking effects; the spring housing 124 is joined to an upper surface approaching a rear end of the stationary blade seat 11, with the upper blade seat 122 being adhered to an upper surface of the stationary blade 111, such that the upper blade assembly 12 is allowed with sliding movements at the stationary blade seat 11 and a cutting edge of the upper blade 121 is projecting from a front end of the electric hair cutter housing 2;

a spring blade 3, which appears slightly as a V shape provided between the upper blade seat 122 and the spring housing 124, and has one end thereof butted against and fixed to the spring housing 124 and the other end thereof butted against and fixed to a rear end of the stationary blade 111, such that the spring housing 124 is capable of restoring to an original position thereof using a restoring force of the spring blade 3 when being moved forward;

a pushing block 4, which is joined to the sliding channel 112 at the rear end of the stationary blade seat 12 using a fastening block 41 thereof to provide the pushing block 4 with sliding movements in the sliding channel 123, and has a front end thereof butted against the spring housing 124 to allow the pushing block 4 to push the spring housing 124 with a certain distance; and a rotary wheel 5, which is a hollow structure having anti-slippery patterns 51, poking rods or other poking objects at a periphery thereof; a hollow locating pillar 52 at a center thereof to provide the rotary wheel 5 with a slightly bulging cross-section; and an adjustment region 53 having a first wall 531 and a second wall 532, and an ascending step-like adjustment portion 533 with a plurality of steps.

The rotary wheel 5 is fixed to a front end of the electric hair cutter housing 2, with an end portion of the rotary wheel protruding out of the electric hair cutter housing 2, so as to provide adjustment when turned. The fastening block 41 of the pushing block 4 is accommodated in the adjustment region 53 of the rotary wheel 5, and is lodged at one of the steps of the adjustment region 53, such that a rotatable distance of the rotary wheel 53 is limited between the first wall 531 and the second wall 532. The rotary wheel 5 is penetrated by an output terminal 61 of a motor 5, and the output terminal 61 of the motor 6 is positioned with the fastening groove 1221 of the upper blade seat 122 to further drive the upper blade seat 122 for left and right movements at the stationary blade 111.

Figure 5:
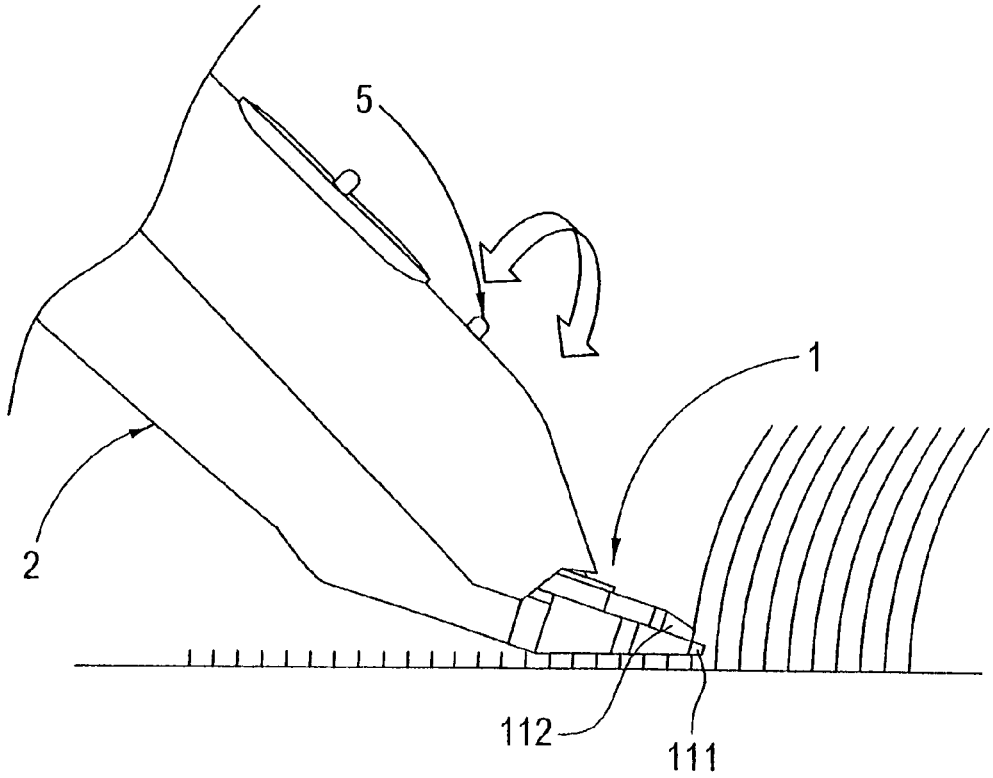
FIG. 5 and FIG. 6 show schematic views illustrating operations of the adjustable apparatus for a hair clipper according to the invention.
Figure 6:
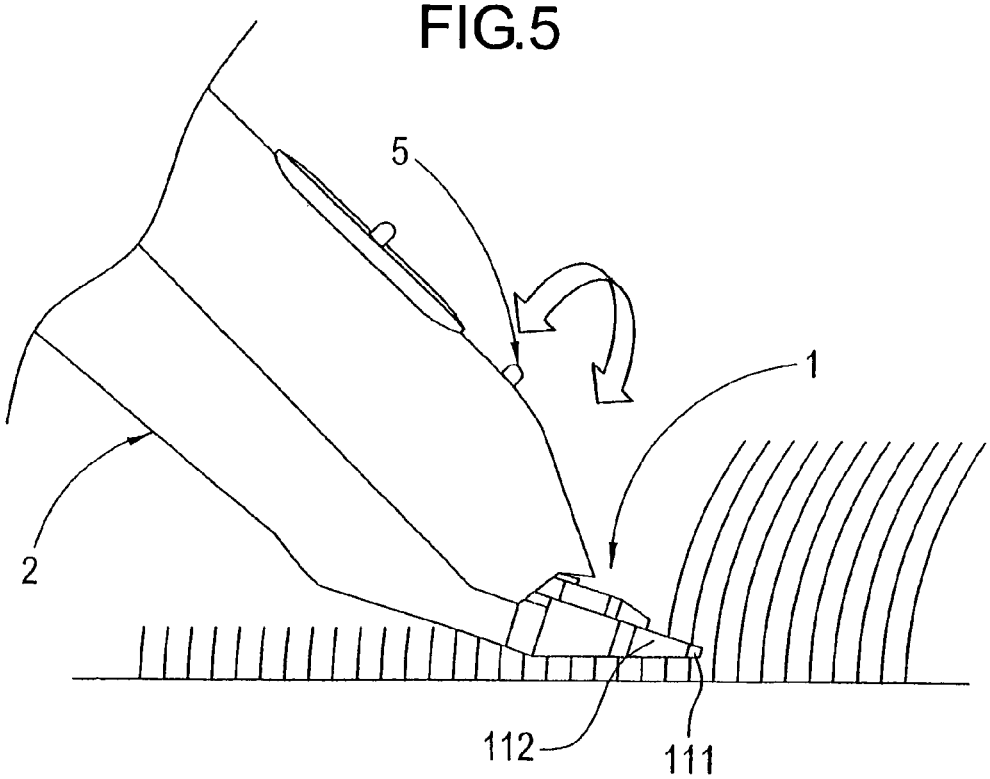

Referring to FIG. 3, FIG. 4, FIG. 5 and FIG. 6 showing schematic views illustrating operations according to the invention, to adjust the upper blade 121 to move forward, the electric hair cutter housing 2 is held by one hand of a user, and the rotary wheel 5 protruding out of the electric hair cutter housing 2 is turned towards the second wall 532 at the adjustment region 53 above. Thus, the fastening block 41 of the supporting block 4 is driven by rotation of the rotary wheel 5 to become fixed at an upper or even higher level at the adjustment portion 533. The pushing block 4 is also affected by the upward movement and fastening of the fastening block 41 to slide forward with a certain distance, and to further propel the spring housing 124 and the upper blade seat 122 forward with a same distance, while also keeping the spring housing 124 supported to locate the spring housing 124 and the upper blade seat 122. At this point, the spring blade 3 is compressed to produce a restoring force from the forward movement of the spring housing 3. Vice versa, to adjust the upper blade 121 to move backward, the rotary wheel 5 is turned towards the first wall 531 at the adjustment region 53 above. Thus, the fastening block 41 of the supporting block 4 is driven by rotation of the rotary wheel 5 to become fixed at a lower level at the adjustment portion 533. The pushing block 4 is moved backward with a certain distance to liberate the spring housing 124 that is then also moved backward with a same distance using the restoring force of the spring 3 and supported by the front end of the pushing block 4. Therefore, using steps of different levels at the adjustment portion 533 of the rotary wheel 5, distances of the pushing block 4 being moved forward or backward are controlled to have the pushing block 4 propel the upper blade assembly with same distances, thereby easily adjusting distances of the upper blade 121 being moved forward or backward to provide a user with simple and handy operations when cutting hair. A user is only required to use one hand to apply small forces for controlling the rotary wheel 5 to the right or to the left as shown in FIGS. 5 and 6, thereby accomplishing objects of operating the electric hair cutter with ease and convenience.

The adjustable apparatus for a hair clipper according to the invention has the excellences described below when compared with the prior invention.

1. Using the steps of different levels at the adjustment portion of the rotary wheel according to the invention, distances of the pushing block being moved forward or backward are controlled to have the pushing block propel the upper blade assembly with same distances, thereby easily adjusting distances of the upper blade being moved forward and backward as well. Thus, a user is only required to use one hand to apply small forces for controlling the rotary wheel to the right or to the left, thereby accomplishing objects of operating the electric hair cutter with ease and convenience.

2. Apart from simple assembly process and operation as well as low production costs, the invention also promotes advancement of the electric hair cutter industry.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An adjustable apparatus for a hair clipper, comprising:

a blade assembly joined to a front end of an electric hair cutter housing, and having a stationary blade seat with a stationary blade at a front end thereof and an upper blade assembly; wherein, the upper blade assembly has an upper blade seat with an upper blade at a front end thereof and a spring housing having a locating spring secured at an interior thereof; and the upper blade assembly is joined to an upper surface of the stationary blade to locate the upper blade seat of the upper blade assembly at a front end of the stationary blade seat, and the spring housing is located at a rear end of the stationary blade seat;

a spring blade having one end thereof butted against and fixed to the spring housing, and the other end thereof butted against a rear end of the stationary blade;

a pushing block having a fastening block extended from a rear end thereof, and joined to the rear end of the stationary blade seat to butt against the spring housing for allowing movements thereof at the stationary blade seat; and a hollow rotary wheel having a hollow locating pillar, which is provided with an adjustment region having a step-like adjustment portion at an interior thereof; wherein, the rotary wheel is joined to a front end of the electric hair cutter housing to have an edge of the rotary wheel protrude from the electric hair cutter housing while allowing the rotary wheel to be turned; the fastening block of the pushing block is accommodated in the adjustment region of the rotary wheel and is lodged into the step-like adjustment portion, such that the rotary wheel is enabled to rotate within the adjustment portion; by lodging into steps of different levels of the step-like adjustment portion, the pushing block is moved forward or backward; when the pushing block is moved forward, the upper blade assembly is propelled forward to produce a restoring force from compression of the spring blade; and when the pushing block is moved backward, the upper blade assembly is moved backward by the restoring force of the spring blade.

2. The adjustable apparatus for a hair clipper in accordance with claim 1, wherein the stationary blade seat is provided with a sliding channel at a rear end thereof, and the sliding channel is for joining with the pushing block to allow the pushing block with sliding movements in the sliding channel.

3. The adjustable apparatus for a hair clipper in accordance with claim 1, wherein the spring blade is a V shape.

4. The adjustable apparatus for a hair clipper in accordance with claim 1, wherein the rotary wheel has a cross-section with a bulging side, and is provided with anti-slippery patterns at a periphery thereof for facilitating turning control thereof.

5. The adjustable apparatus for a hair clipper in accordance with claim 1, wherein the rotary wheel has a cross-section with a bulging side, and is provided with a poking rod at a periphery thereof for facilitating turning control thereof.

6. The adjustable apparatus for a hair clipper in accordance with claim 1, wherein the adjustment region of the rotary wheel is provided with a first wall and a second wall, such that a turning distance of the rotary wheel is a distance between the first wall and the second wall.

7. The adjustable apparatus for a hair clipper in accordance with claim 6, wherein an ascending step-like adjustment portion is provided between the first wall and the second wall of the adjustment region, and the adjustment portion is consisted of a plurality of steps.

* * * * *